US011910843B2

(12) United States Patent
Busnel et al.

(10) Patent No.: US 11,910,843 B2
(45) Date of Patent: Feb. 27, 2024

(54) MULTI-WAY SIZING BRA

(71) Applicants: Elodie Busnel, Chicago, IL (US); Francesca D'Arcy, Chicago, IL (US)

(72) Inventors: Elodie Busnel, Chicago, IL (US); Francesca D'Arcy, Chicago, IL (US)

( * ) Notice: Subject to any disclaimer, the term of this patent is extended or adjusted under 35 U.S.C. 154(b) by 131 days.

(21) Appl. No.: 16/858,585

(22) Filed: Apr. 25, 2020

(65) Prior Publication Data

US 2020/0337389 A1 Oct. 29, 2020

Related U.S. Application Data

(60) Provisional application No. 62/838,734, filed on Apr. 25, 2019.

(51) Int. Cl.
*A41C 3/00* (2006.01)

(52) U.S. Cl.
CPC ..... *A41C 3/0028* (2013.01)

(58) Field of Classification Search
CPC ..... A41C 3/0071; A41C 3/0028
USPC ..... 450/36, 88
See application file for complete search history.

(56) References Cited

U.S. PATENT DOCUMENTS 2,706,816 A * 4/1955 Dozier ..... A41C 3/04 450/36
3,740,765 A * 6/1973 Delplace ..... A41D 7/00 2/67
8,506,349 B2 * 8/2013 Sobah-Wilhelm ..... A41C 3/10 450/57
2006/0003669 A1 * 1/2006 Li ..... A41F 15/002 450/58
2006/0079153 A1 * 4/2006 Davidson ..... A41C 3/02 450/58
2007/0123148 A1 * 5/2007 Heer ..... A41D 15/00 450/77
2009/0258572 A1 * 10/2009 Chayo ..... A41F 15/002 450/39
2010/0178847 A1 * 7/2010 Buriak ..... A41C 3/0064 450/39
2010/0261410 A1 * 10/2010 Hirtz ..... A41C 3/04 450/36
2011/0081826 A1 * 4/2011 Hendrickson ..... A41C 3/0028 450/36
2012/0184179 A1 * 7/2012 Blitz ..... A61M 1/062 450/36

(Continued)

*Primary Examiner* — Gloria M Hale
(74) *Attorney, Agent, or Firm* — Kimberlee Jones; Golan Christie Taglia LLP

(57) ABSTRACT

An undergarment able to adapt its back size, cup size, strap lengths and secureness of fit all while transforming to a convertible bra for breastfeeding for nursing mothers. Particularly a high quality, well-fitting bra that can facilitate the stages of bra-wearing and nursing practicably and inexpensively. It eliminates the costs required to purchase different sized bras in response to changes in bra size during different stages of life as in puberty, pregnancy, weight gain or loss and beyond by providing options. It is a functional bra offering support for nursing with large, average and small breasts. Present invention, because of interchangeable detachable components, provides users with different options when needed. Preferred embodiment of present invention provides base components able to interchange cups, bands and straps allowing replacement of components to suit body changes.

5 Claims, 7 Drawing Sheets

Front View of Cups (detached)

(56) References Cited

U.S. PATENT DOCUMENTS

| | | | | |
|---|---|---|---|---|
| 2015/0004877 | A1* | 1/2015 | Bailey | A41C 3/0028<br>450/86 |
| 2016/0150833 | A1* | 6/2016 | Spicer | A41C 3/06<br>450/70 |

* cited by examiner

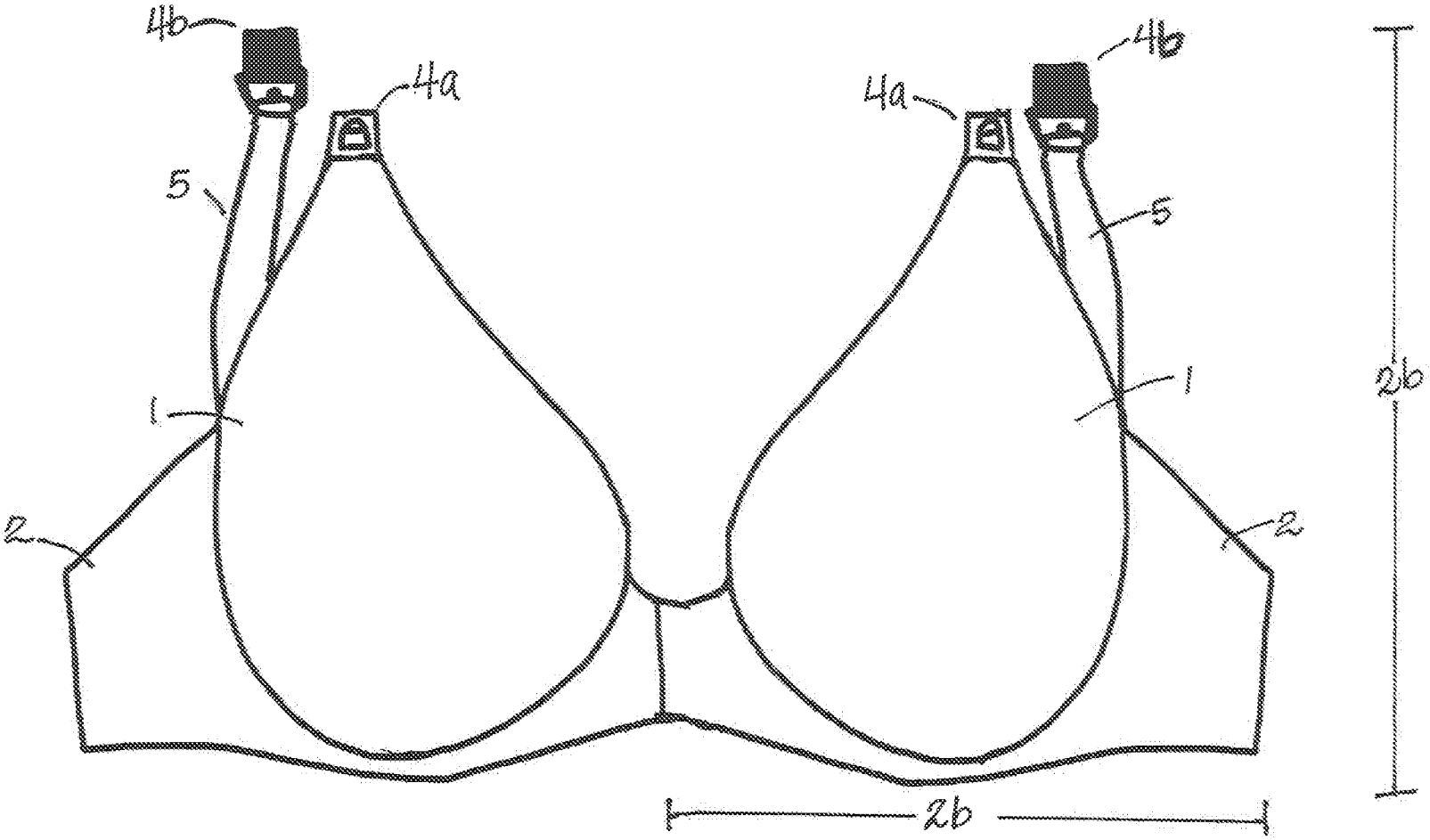
FIG 1: Front View of Cups

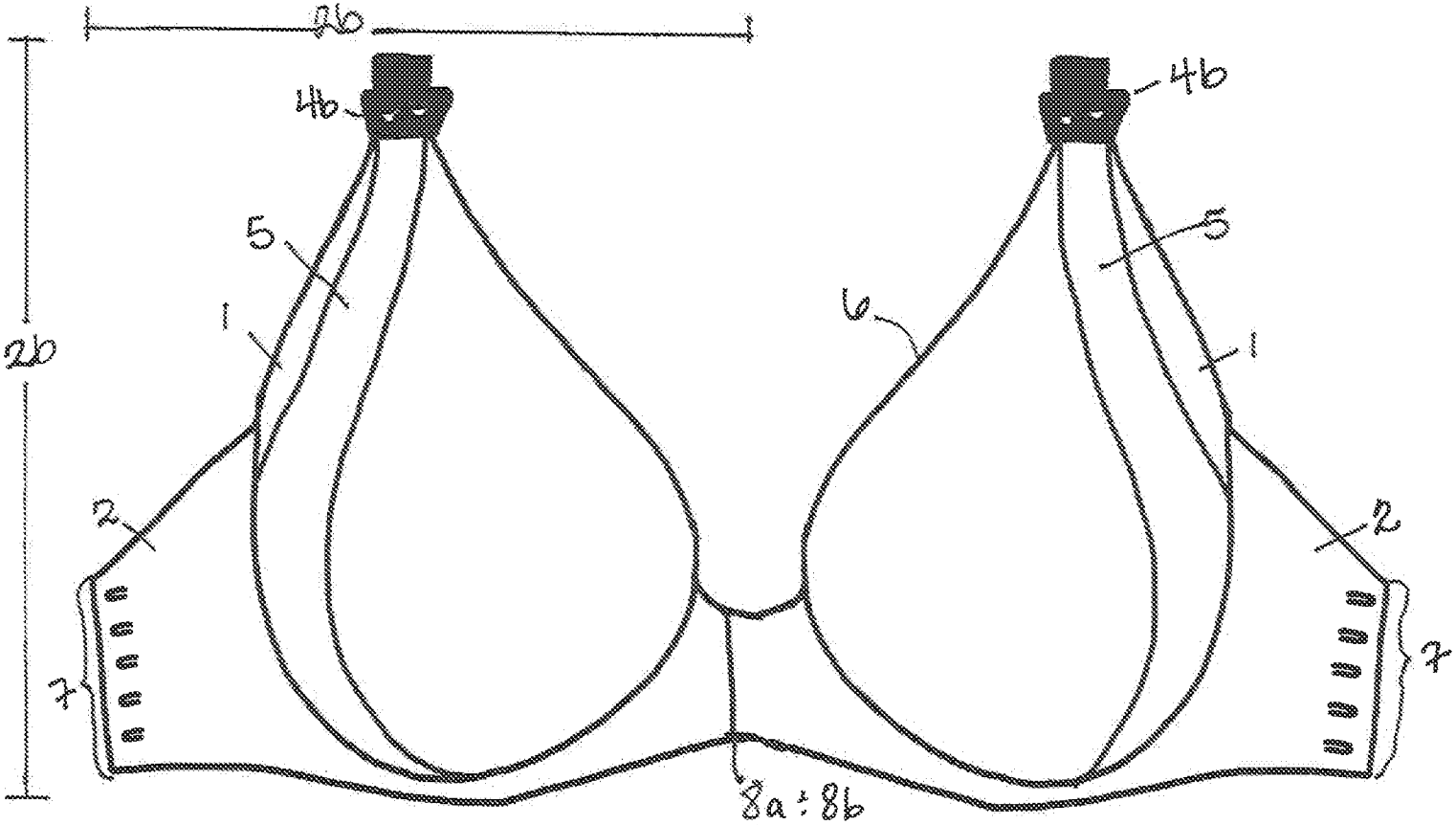
FIG 2: Back View of Cups (fully assembled)

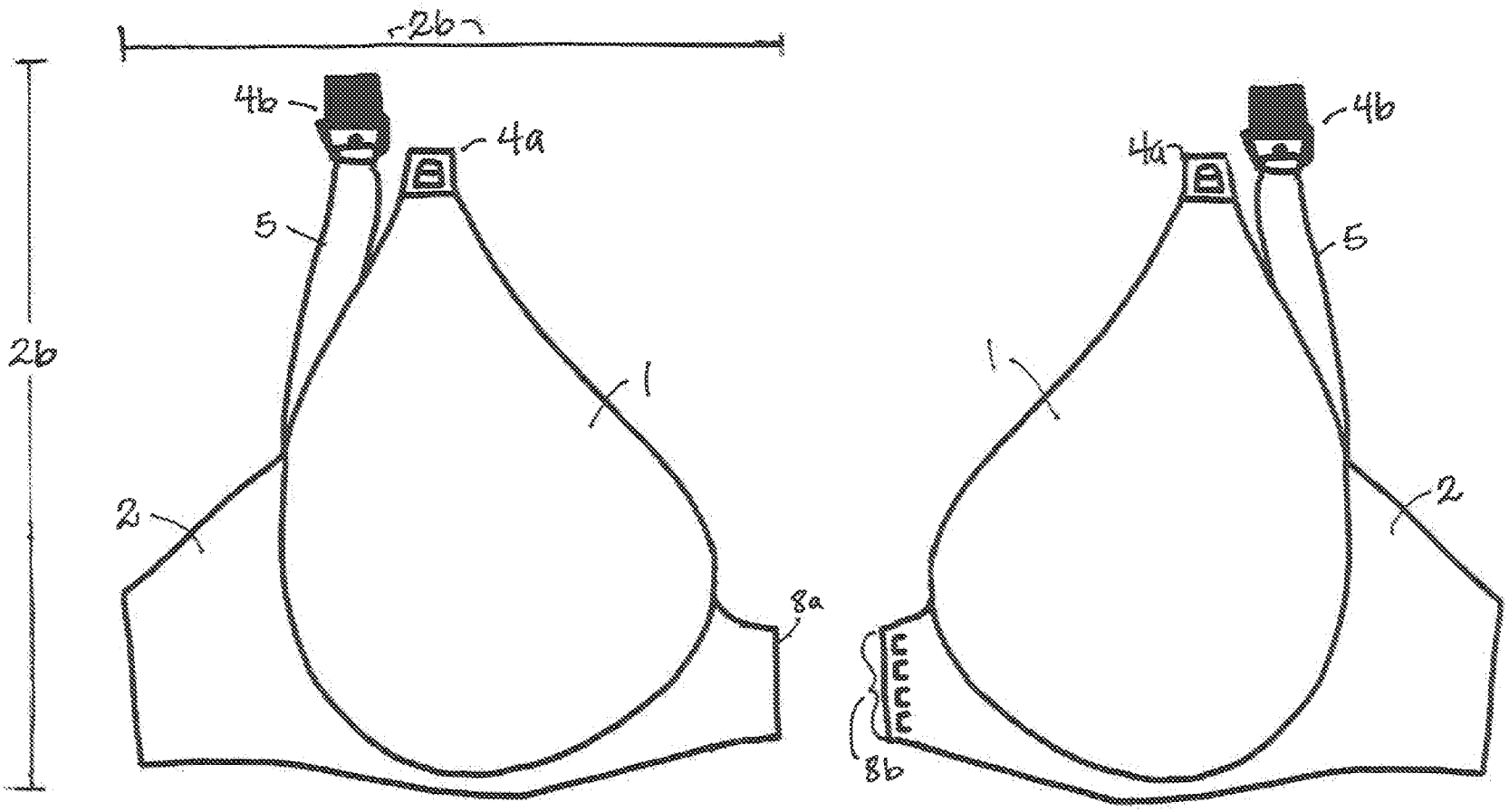
FIG 3: Front View of Cups (detached)

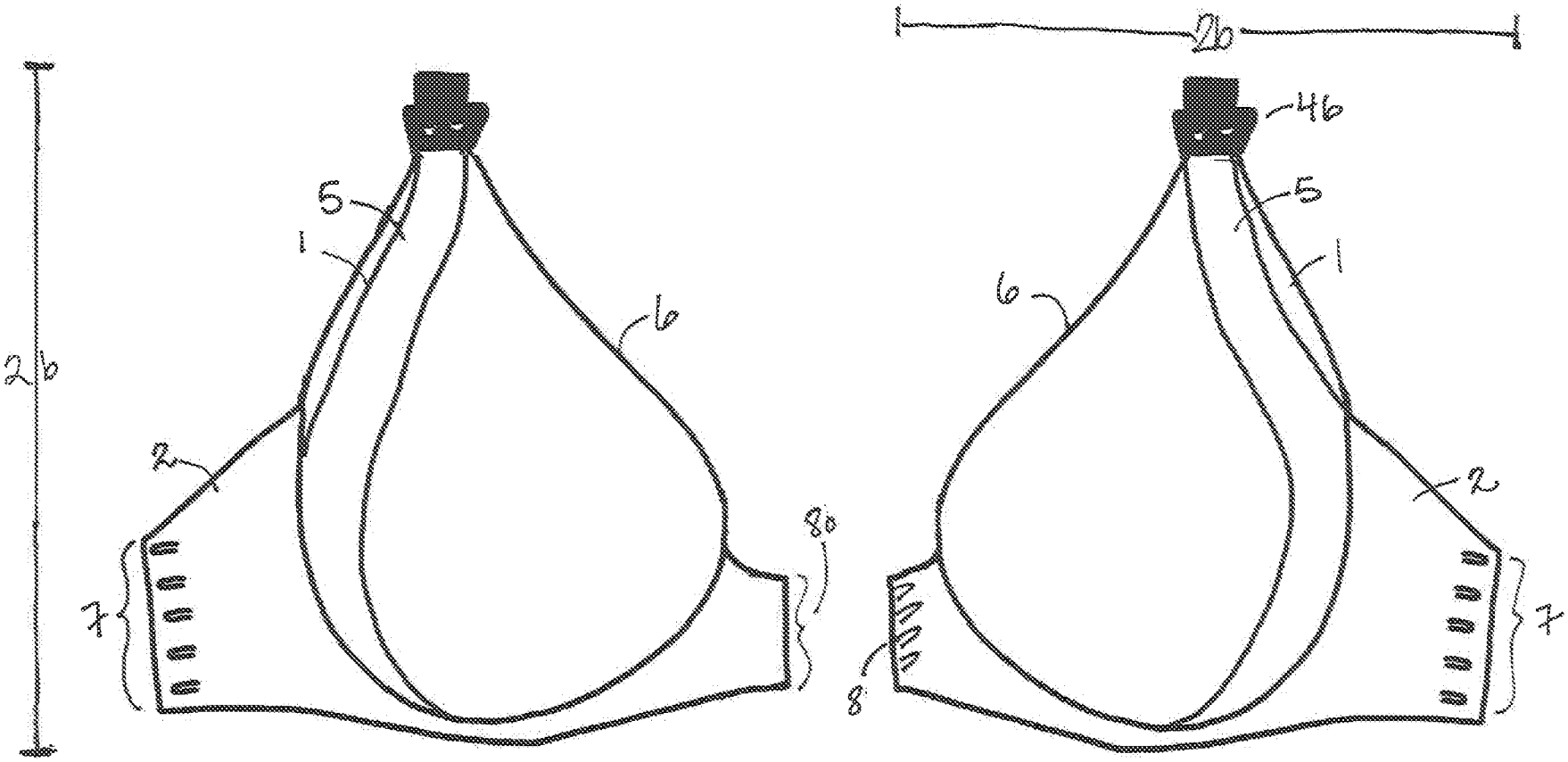
FIG 4: Back View of Cups (detached)

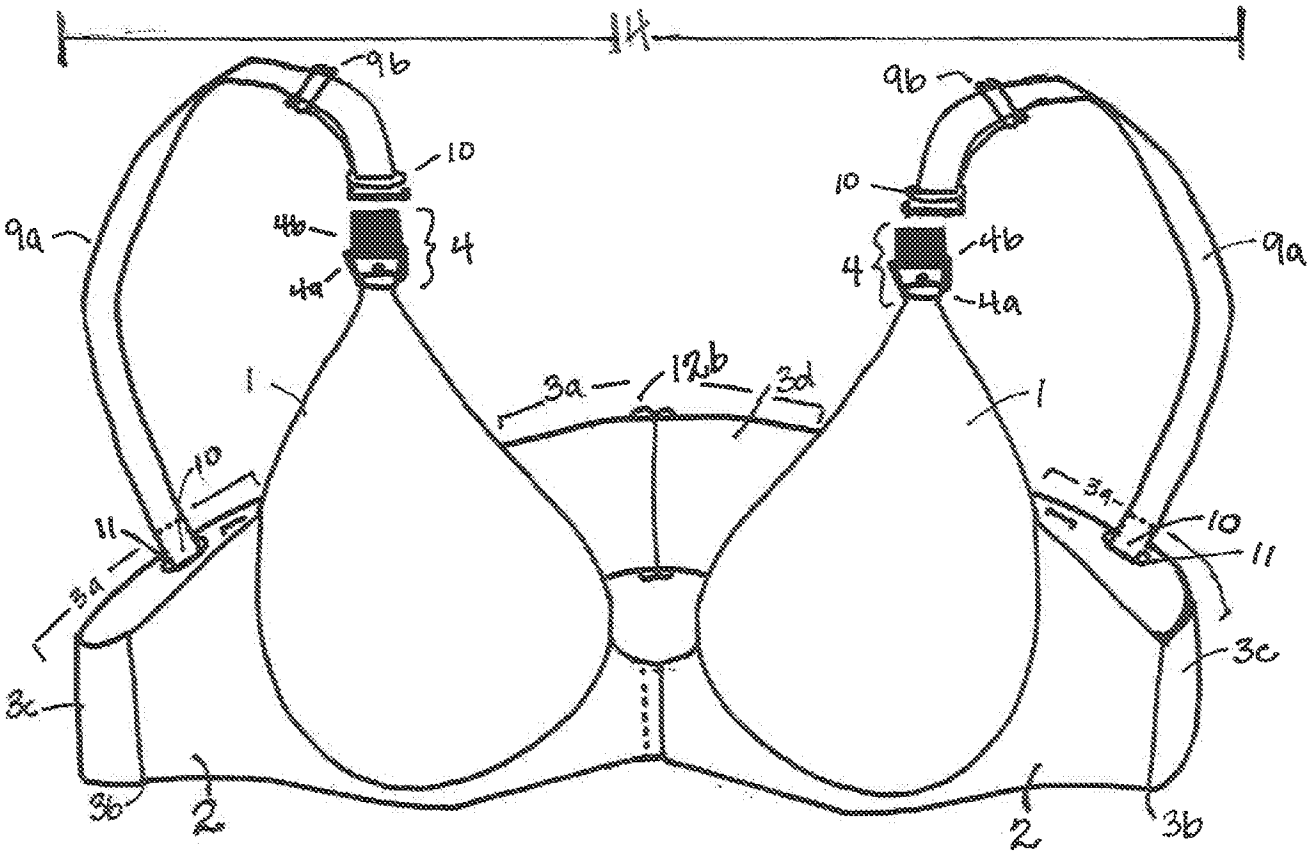
FIG 5: Front View of Bra

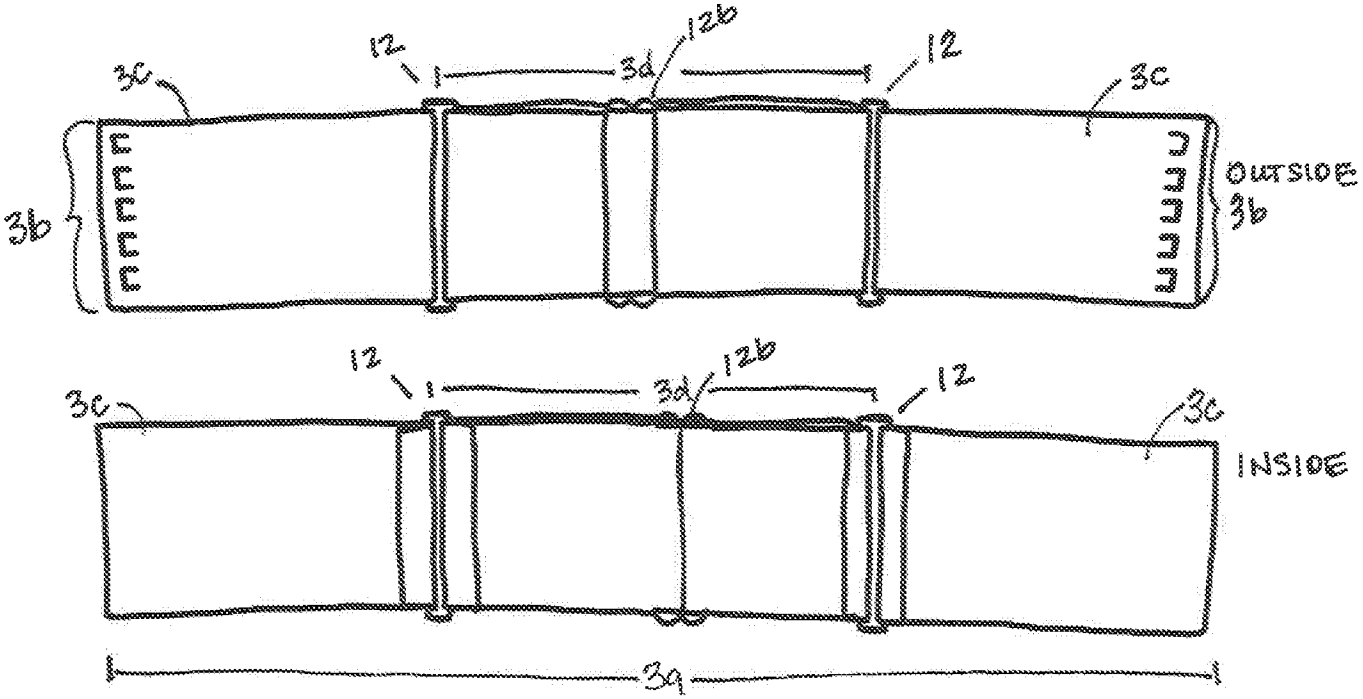
FIG 6 - Outside and Inside View of Back Band

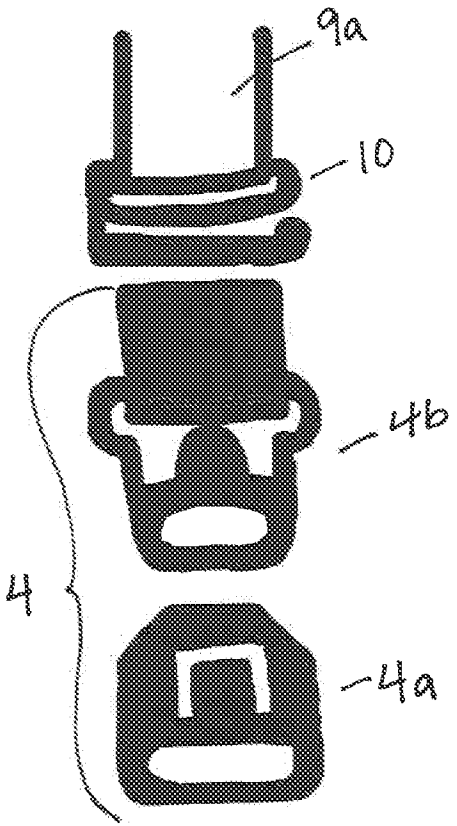
Original Design Clasp - detachable from shoulder strap
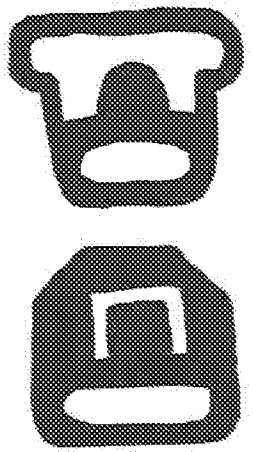
Traditional clasp (FOR EXAMPLE)
FIG 7: Custom Clasps

MULTI-WAY SIZING BRA

CROSS REFERENCE TO RELATED APPLICATIONS

This non-provisional patent application claims priority to provisional patent U.S. 62/838,734 filed 25 Apr. 2019 pursuant to 35 USC § 119(e) the disclosure of which is incorporated herein by reference in its entirety.

BACKGROUND OF INVENTION

1. Field of Invention

The field of invention is garments designed to shape and support breasts of any size and any type as well as undergarments facilitating nursing/breastfeeding. The current state of the art for brassieres consists of expensive, hard-to-fit, sometimes rigid or not rigid enough garments which have to be broken in or sometimes worn too big or too small in order to be comfortable. There are several makers of brassieres but the technology has not evolved in the area represented by the present invention. The technology in brassieres has been mostly associated with sports or fitness-appropriate bras touting support, shock absorbency or style. Maternity or nursing bras have been stagnant in development and have not presented new technology making them more user-friendly or comfortable in recent art.

Women go through many sizes throughout life requiring different sized clothing. Beginning in puberty, women begin wearing bras and, they too, need to be adjusted to the different sizes a woman goes through in her lifetime. Further, when a woman is about to give birth or is nursing, she requires even more versatility in her bra. Women's lingerie is costly but necessary; and bras tend to be one of the more expensive items. Not only are bras costly, but they do not always fit or allow for comfortability even after all of the money spent. Bra-users tend to wear the wrong size bra for a number of reasons.

First, women tend to hold on to improperly sized bras beyond the time they should. The bra either does not fit or does not suit the purpose for which it was originally purchased. Another reason women tend to wear the wrong size bra is they have life events which cause them to "size up" or "size down" meaning change a size in either direction and because bras are so costly; women tend to just tolerate the bra they already have versus buying a new appropriately sized, better-fitting bra. Also, bras require "breaking in" which means wearing a new bra until it becomes comfortable and once comfortable; it becomes an item not easily discarded, even when it should be, as it was not easily attained.

Women also tend to establish favorite garments. For the aforementioned reasons, once a woman has established a garment or undergarment, in this case a bra, as a "favorite," it is definitely not discarded. Thus, women, for one reason or another, tend to wear the wrong sized brassieres because they reach "favorite status" and the current invention helps provide a cost-effective solution to all of the above issues.

The present invention is an answer to the changing needs of women when facing pregnancy-induced weight gain or any short-term weight gain or loss which causes body changes enough to make the bras they have unfit because of size or purpose or both. Present invention provides a solution integrating into one garment the ability to accommodate temporary or permanent changes in the user's body size with the functionality that also facilitates nursing/breastfeeding.

Present invention saves money and time by being a bra comprised of interchangeable components having both convertible and adjustable/retractable features making it fully adaptable for short-term and permanent body changes further able to facilitate breast-feeding.

2. Related Art

Bras can be ill-fitting, cost-prohibitive, uncomfortable and sometimes unstylish. A need for a different sized bra does not always trigger bra-users to address said need. Bras have become more prominent pieces of wardrobes and can now be seen as part of an outfit, not just as an undergarment. Bras have also become functionally sound for several different purposes from nursing to exercising. Even with the evolution of the bra, there are still short comings. In the current state of the art, bras still lack adaptability for purpose and for fit at the same time in the same garment. There are bras that are singularly adaptable for style, support, fit, maternity needs or even medical reasons post-surgery; but none, however, that combine these elements to make a single option superior in purpose and fit, until present invention. Efforts in the area include the following:

Prill, U.S. Pat. No. 9,345,274, discloses a nursing device consisting of a strap used to connect the nursing bra to a nursing bra cover to facilitate nursing or breast-feeding a baby. The strap is designed to hold a nursing bra in the proper place for a nursing baby and also to provide a cover garment to shroud the baby which helps to facilitate breast-feeding. The strap means is the connector by which this invention achieves its inventive purpose.

Ives-Keeler, U.K. Patent Application No. 2,558,664, discloses a bra for use post-surgery that is more "comfortable to put on, wear and take-off, and which minimizes the risk of irritation or trauma to healing or scarred tissue." The invention is a bra with separate parts to facilitate the ease of wearing the bra as well as putting it on and removing it.

Elyse, U.S. Patent Application No. 2019/0,008,214, discloses a support article, namely a bra, and more particularly a sports bra that is able to allow the user the ability to adjust the level of support required from the support article at any given time based on the activity level anticipated by the user. The support article can be used for activities requiring a lot of support or for day-to-day wear.

Pfister, U.S. Patent Application No. 2018/0492,710, discloses a "modular garment" with "interchangeable support configurations" for the purpose of supporting a strapless bra with a bralette for the proper support when wearing garments where showing straps may be considered an "unkempt" or "unfashionable" look, but the support of straps is still needed by the user. The subject of the invention is to provide support and style for users requiring more support even when they cannot use "unfashionable" straps by providing a bralette which is fashionable and also provides necessary support.

Chabaud, French Patent Application No. 3,082,393, discloses a "personalized bra" made to fit a user as if the bra has been "tailor-made." The cups are designed to fit the users "morphological parameters" to avoid "negative consequences" of an ill-fitting bra. The cups of the bra are removable and have a rod extending the length of the cup from top to bottom that can be manipulated to change the cup's shape for a more or a less snug fit.

Woo, Korean Patent No. 102,082,797, discloses an adjustable bra where the spacing between the garment's cups can be changed by using a dial. This bra is able to adjust the distance between the cups to accommodate the changes a user may go through where the user's breast does not fit in the bra as is because of "hormonal changes" for instance. Changes that cause the bra to be ill-fitting can be accommodated by adjusting the fit of the bra by tightening or loosening the cups around the breasts by adding or reducing space between the cups using the dial for adjustment.

Flaherty, U.S. Pat. No. 6,186,861B1, discloses a bra with straps that can be changed based on the clothing being worn so as to make the straps match the article of clothing. The straps can be of varying material, thickness and color made to match or "play off" the color of the clothing.

3. Summary

Exemplary embodiments of the present invention provide a multi-way sizing bra to accommodate a user's body throughout life-changing events. In one embodiment, the exemplary multi-way sizing bra has several components enabling user to interchange parts of the present invention for an adapted fit. In yet another embodiment, the exemplary multi-way sizing bra has several components enabling user to convert from a regular bra to a bra that facilitates nursing/breast-feeding. And in yet another embodiment, the exemplary maternity multi-way sizing bra can do both—adapt to fit and convert to a nursing bra. All present and future exemplary embodiments will reduce the cost of purchasing lingerie, namely bras, overtime; decrease wear and tear on any one component of a bra; and provide the best fit.

In accordance with embodiments of the present invention, the multi-way sizing bra accommodates changes occurring in any part of the body corresponding to bra-wearing including a change in back size, breast size, level of support needed and function of the breast (for nursing). Further, in accordance with embodiments of the present invention it can adapt in color and style. Present invention, with reduction of costs and increase in fit as focal points, allows for interchangeable, flexible convertible bra cups, adaptable adjustable shoulder straps, integrated maternity clasps and replaceable adjustable back bands keeping it adaptable to style & function while at the same time cost-effective as well as a best-fitting bra for both specialized and daily use.

The exemplary embodiment of the present invention is a brassiere consisting of several interchangeable pieces comprising a replaceable adjustable back band, replaceable left and right adjustable shoulder straps, a maternity clasp, and flexible left and right bra cups with a convertible feature to facilitate nursing a baby connected to bra cup panels forming the bra cup panel assembly.

The bra cup panel assembly having the ability to be interchanged with other bra cup panel assemblies of varying styles, sizes and functions for the user to achieve a custom fit, over and over again but saving on the costs of new bra purchase. The exemplary embodiment has a front closure which is not a limitation on present invention.

The replaceable adjustable back band is a durable but flexible textile and elastic material made to breathe and stretch for the user's comfort. The replaceable adjustable shoulder straps, one for the left side and one for the right side of the garment are both made to adjust for the user's support, style and comfort requirements to be made with a similar if not the same durable flexible, breathable, stretchable textile as the replaceable adjustable back band and replaceable bra panel assembly; further able to change in color and style.

The two bra cup panels are comprised of a cup structure contoured to receive a breast. In yet another exemplary embodiment, the cup is affixed to the maternity multi-way sizing bra with a maternity clasp for nursing which enables the cup to partially detach as a convertible feature to expose the breast without removing the entire bra to nurse. The cup is anchored to the bra cup panel allowing for the cup to be unattached and reattached, as needed, over and over again.

There are a plurality of fasteners facilitating the maternity multi-way sizing changes possible with this garment. There are fasteners in the front of the maternity multi-way sizing bra connecting the right and left bra panel assemblies. These fasteners are located on the bra panel under the bra cup to connect the replaceable bra panel assembly at the sternum of user. There are fasteners located on the bra panel to connect the replaceable bra panel assembly to the replaceable adjustable back band under the user's armpit for a secure fit. There is a convertible fastener clasp at the top of each bra cup which can be connected to a fastener clasp to create a maternity bra. This clasp facilitates nursing.

The bra panels include fasteners in a vertical linear symmetry on the outer portion of the flexible bra panel, opposite the inner fasteners on the other portion, to align with the fasteners on the complementary band for which they are to connect to create the construction of the garment. Each adjustable connector (replaceable adjustable back band, replaceable left adjustable shoulder strap and replaceable right adjustable shoulder strap) has fasteners to connect to the maternity multi-way sizing bra in the appropriate capacity to facilitate a complete garment with proper support and fit. On each end of the replaceable adjustable strap there is a hook; one to attach to the replaceable bra panel assembly via the maternity clasp and one to attach to the back band loop. The replaceable adjustable back band has a plurality of fasteners to facilitate attachment. Each band and strap have an adjustable means which facilitates lengthening or shortening said band or strap for the user's specific fit, support and comfort level. Each strap and band have a loop to facilitate adjusting means.

Components and features of present exemplary embodiment will become more apparent from the following detailed description considered in conjunction with the accompanying drawings. It is to be understood, however, that the drawings are designed as an illustration of a single embodiment and not the only embodiment, and therefore, not as a definition of limits of the present disclosure.

BRIEF DESCRIPTION OF THE DRAWINGS

FIG. 1 illustrates the front view of one of the exemplary embodiments of the present invention showing the front view of the flexible right and left bra cups attached to the right and left flexible bra panels to create the replaceable bra panel assembly attached to each other via the male and female fasteners (concealed by closure) inclusive of the bra strap and maternity clasp with integrated loop which is fully disassembled to show the male portion with integrated loop as it is affixed to the bra strap and the female portion as it is affixed to the top of the flexible bra panel to facilitate the maternity feature.

FIG. 2 illustrates the back view of one of the exemplary embodiments of the present invention showing the inside of the flexible convertible bra cups connected to each other by the inner female and male fasteners (concealed by closure) on the replaceable right bra cup panel assembly and left bra cup panel assembly over the sternum of user.

FIG. 3 illustrates the front view of the same exemplary embodiment in previous figures of present invention showing the replaceable right bra cup panel assembly and left bra cup panel assembly detached exposing the fasteners on the inner portion on the front side of the left flexible convertible bra cup panel with the bra straps unattached to the flexible convertible bra cups at the maternity clasp exposing the male and female portion of the maternity clasp FIG. 4 illustrates the back view of the same exemplary embodiment in previous figures of the present invention showing the back of the replaceable right bra cup panel assembly and the left bra cup panel assembly detached and the inside of the flexible convertible bra cups with the integrated flexible bra panel, bra straps and the outer fasteners affixed to outer portions of the left and right flexible bra panel; and the inner fasteners on the inside of the right flexible bra panel.

FIG. 5 illustrates the front view of the same exemplary embodiment in previous figures of present invention fully assembled as a maternity multi-way sizing bra with attached replaceable adjustable shoulder straps, attached replaceable right and left bra panel assemblies and an attached replaceable adjustable back band.

FIG. 6 illustrates the outside and inside view of the replaceable adjustable back band with wings, elasticized material, sliders and back band adjuster.

FIG. 7 illustrates an example of a traditional maternity clasp on the left and the maternity clasp with integrated loop subject of present invention shown on the right. The maternity clasp with integrated loop is shown detached to expose the male and female portions of the maternity clasp. The male portion of the maternity clasp has an integrated loop. The shoulder strap hook at the distal end of the replaceable adjustable shoulder strap is shown to emphasize the design of the male portion of the maternity clasp with integrated loop and how it is to function and receive the shoulder strap hook to facilitate detaching and attaching various replaceable adjustable shoulder straps.

DETAILED DESCRIPTION

Referring now specifically to the figures, FIGS. 1-4 illustrate a first embodiment of the bra 14 with the replaceable left and right bra panel assemblies 2*b* comprising flexible convertible bra cups 1 and flexible bra panels 2 from both front and back views. FIG. 1 illustrates the front view of the flexible convertible bra cups 1 integrated with the flexible bra panels 2 to make up the replaceable bra panel assembly 2*b* which is interchangeable, able to be replaced with different sized flexible convertible bra cups 1 and flexible bra panels 2 making up the different sized replaceable bra panel assembly 2*b*. Integrated into the flexible convertible bra cups 1 are the bra straps 5 which house the male portion of the maternity clasp with integrated loop 4*b* which connects to the female portion of the maternity clasp portion 4*a* that is integrated into the top of the flexible convertible bra cup 1 facilitating the convertible feature of the bra cups 1 for nursing which ultimately connect to the replaceable adjustable shoulder strap ga in one preferred embodiment.

FIG. 2 illustrates the back view of the flexible convertible bra cups 1 fully connected to each other by the female 8*b* and male bra panel fasteners 8*a* on the inside and outside of the left and right replaceable bra panel assembly 2*b* at the sternum of user. A view of the fully integrated bra straps 5 inside the flexible convertible bra cups 1 with the male portion of the maternity clasp with integrated loop 4*b* located at the top end of the bra straps 5 can be seen in the position where they would be when attached to the flexible convertible bra cups 1 extending up from the flexible bra panel 2 and the female portion of the maternity clasp 4*a*. The maternity clasp 4 is fully assembled ready for the replaceable bra panel assembly 2*b* to attach to the replaceable adjustable back band and replaceable adjustable shoulder straps in this illustration. FIG. 2 further illustrates a first embodiment of the inside of the flexible convertible bra cup 6 which can be padded, lined or neither as it attaches to the flexible bra panels 2 where the replaceable bra panel assembly's 2*b* outer fasteners 7 can be seen as they connect to the replaceable adjustable back band 3*a* via the replaceable adjustable back band fasteners 3*b* as shown in FIG. 6 to fully assemble the maternity multi-way sizing bra 14.

As the bra 14 is fully detachable, FIG. 3 illustrates each replaceable bra panel assembly 2*b* disassembled via the front view. Detaching the replaceable bra panel assembly 2*b* from the other by disconnecting the inner male 8*a* and female 8*b* fasteners making the replaceable right and left bra panel assemblies two distinct pieces. The male portion of the maternity clasp with integrated loop 4*b* and the female portion maternity clasp portion 4*a* are not connected in FIG. 3 showing each portion of the maternity clasp 4 as they are when separate.

As the bra 14 is fully detachable, FIG. 4 illustrates the back view of each replaceable bra panel assembly 2*b*, including the flexible convertible bra cups 6 and the flexible bra panels 2 detached from each other. The male portion of the maternity clasp with integrated loop 4*b* is shown attached to the female portion of the maternity clasp portion 4*a*. The replaceable bra panel assembly's 2*b* outer fasteners 7 are fully exposed as the bra 14 is not attached to the replaceable adjustable bra band 3*a* as it is in FIG. 5, via the replaceable adjustable back band fasteners 3*b* shown in FIG. 6.

As the bra 14 is fully assembled in the first exemplary embodiment, all of the fasteners, clasps and loops are connected to show a fully assembled maternity multi-way sizing bra 14 in FIG. 5 from the front view. FIG. 5 illustrates each piece of the bra 14 including the replaceable adjustable back band 3*a* which houses the back band loops 11. In various embodiments, the back band loops 11 connect the replaceable adjustable shoulder straps 9*a* to the bra 14 via the replaceable adjustable shoulder strap hooks 10. The replaceable adjustable shoulder strap 9*a* is adjustable via the shoulder strap adjuster 9*b*. The ends of the replaceable adjustable shoulder strap 9*a* opposite of each other are hooks. The replaceable adjustable shoulder strap hook 10 on each adjustable shoulder strap 9*a* attaches to the male portion of the maternity clasp with integrated loop 4*b* when attaching the flexible convertible bra cups 1. In this illustration, the replaceable adjustable back band 3*a* is threaded through the back band adjuster 12*b* in various embodiments. Further, the replaceable adjustable back band 3*a* is comprised of an elastic material section 3*d* and the right and left wings 3*c* which have fasteners 3*b* facilitating bra assembly. The elastic material 3*d* is attached to the wings 3*c* with sliders 12 as adjustment means. The fasteners 3*b* of the replaceable adjustable back band attach to the replaceable bra panel assembly 2*b* by engaging the replaceable adjustable back band fasteners 3*b* to the flexible bra panel's 2 plurality of outer fasteners 7. The convertible feature of the bra 14 is facilitated by the maternity clasp 4 which consists of the female portion of the maternity clasp portion 4*a* and the male portion of the maternity clasp with integrated loop 4*b* as they attach to the replaceable adjustable shoulder strap 9*a*. The male 4*b* and female 4*a* portions of the maternity clasp 4 are integrated into the flexible convertible bra cups 1 and the integrated bra straps 5.

The replaceable adjustable back band 3*a* is illustrated in FIG. 6 to exhibit the wings 3*c*, the elasticized material 3*d*, the replaceable adjustable back band adjuster 12*b*, the sliders 12 and the replaceable adjustable back band fasteners 3*b*. In FIG. 7, the maternity clasp 4 is disassembled to illustrate the female portion of the maternity clasp portion 4*a* and the male portion of the maternity clasp with the integrated loop 4*b*.

What is claimed:

1. A maternity multi-way sizing bra, comprising:

a replaceable maternity right bra cup panel assembly, comprised of a flexible right bra cup having a back-side and a front-side with a female portion of a maternity clasp affixed to facilitate a closure for a flexible convertible bra cup integrated with a flexible right bra cup panel having an inside and a plurality of fasteners affixed to opposite ends of the flexible right bra cup panel to facilitate a front closure configured to lie over a user's sternum and a side closure configured to lie under a user's arm;

a replaceable maternity left bra cup panel assembly, comprised of a flexible left bra cup having a back-side and a front-side with a female portion of a maternity clasp affixed to facilitate a closure for a flexible convertible bra cup integrated with a flexible left bra cup panel having an inside and a plurality of fasteners affixed to its opposite ends of the flexible left bra cup panel to facilitate a front closure configured to lie over a user's sternum and a side closure configured to lie under a user's arm;

a replaceable right adjustable shoulder strap and a replaceable left adjustable shoulder strap; wherein both the replaceable left and right adjustable shoulder straps are further comprised of a combination stretchable, flexible material or textile; and a replaceable adjustable back band, wherein the replaceable adjustable back band is comprised of a stretchable adjustable material or textile having back band loops.

2. The maternity multi-way sizing bra of claim 1, wherein said replaceable maternity right and left bra cup panel assembly is further comprising:

the flexible right and left convertible bra cups and right and left bra cup panels configured on the front-side with a stretchable, flexible textile material and said textile material is comprised of one or a combination of lace, satin, silk, cotton, or polyester;

a flexible convertible bra cup having a proximal and a distal side, a bra strap, a male portion of a maternity clasp having an integrated loop wherein said bra cup includes padding or foam material inside configured to said bra cup to provide further support of user's breast tissue when worn;

wherein a bra strap is connected to the replaceable maternity right bra cup panel assembly and the replaceable maternity left bra cup panel assembly on the distal side of said flexible convertible bra cup furthest away from said replaceable maternity bra cup assembly's inner attachment, extending up from the flexible convertible bra cup panel having a top and fitted at said top, with a male portion of a maternity clasp with integrated loop to provide for attachment and detachment;

wherein a hook provides for attachment or detachment of a replaceable adjustable shoulder strap to the bra strap and the male component of the maternity clasp provides for the attachment or detachment of the flexible convertible bra cup to the multi-way sizing bra;

wherein the bra strap is comprised of a same or similar material as the front-side of said replaceable maternity left and right bra cup panel assembly;

wherein the flexible right and left bra cup is configurable in a plurality of sizes to fit different breast sizes comparable to general bra cup sizes;

wherein said replaceable bra cup assembly is completely detachable from the multi-way sizing bra to accommodate a larger or smaller bra cup assembly;

wherein the replaceable maternity bra cup assembly is fitted with a female component of a maternity clasp to receive the male component of a maternity clasp to provide for opening and closing of the flexible convertible bra cup.

3. The maternity multi-way sizing bra as claimed in claim 2, further comprising replaceable right and left adjustable shoulder straps, a shoulder strap adjuster, and a shoulder strap hook on each end;

wherein the shoulder strap adjuster adjusts length and changes said length of the right or left replaceable adjustable shoulder strap to shorten or lengthen either replaceable adjustable shoulder strap to increase or decrease support of the multi-way sizing bra's flexible convertible bra cups;

wherein the adjustable shoulder strap hooks are located at each end of said strap;

wherein each replaceable adjustable shoulder strap having a hook on each end to receive a loop from the male portion of the maternity clasp with an integrated loop affixed to bra strap and at the opposite end of the replaceable adjustable shoulder strap, another shoulder strap hook to receive the back band loop on the replaceable adjustable back band, wherein together the replaceable adjustable shoulder strap provides support, via the shoulder strap hooks attaching the replaceable bra panel assembly to the replaceable adjustable back band, for the breast.

4. The replaceable adjustable back band of claim 1, comprising:

a right and a left wing each with a back band loop affixed top-side of said wing, to receive the shoulder strap hook, configured from a flexible, stretchable textile having two ends; wherein said flexible stretchable material is permanently affixed in a horizontal orientation and threaded through a plurality of sliders creating an adjustment means to provide for adjusting and connecting to each inside end of the wing;

wherein each wing is configured from the same or similar textile as the front-side of the replaceable maternity bra panel assembly; and each wing having back band loops affixed top-side of the wings to receive shoulder strap hooks integrated on the replaceable adjustable shoulder straps;

wherein each wing's proximal end is affixed to an elasticized material with a slider, threaded through one side of the slider and permanently tacked to affix the slider to the wing keeping the slider in place;

wherein the elasticized material is then threaded through a slider that will act as an adjuster, then through another slider connected to the proximal end of the wing and folded over and tacked down, the opposite end of the elasticized material is threaded through the other slider connected to the distal end of the other opposite wing and then threaded back through the initial slider acting as an adjuster to create the adjusting means wherein the open side is folded over the slider onto itself and tacked to affix the elasticized band in place to further provide the adjustment means for the replaceable adjustable back band to tighten or loosen with free movement of one end of the elasticized material threaded through the slider;

wherein the wings have a plurality of fasteners on the distal ends, opposite the sliders to provide an attachment means to secure the right and left flexible bra panels to facilitate attachment to the replaceable left and right bra panel assembly for support.

5. The maternity multi-way sizing bra of claim 1, having a flexible bra cup that is not convertible but affixed to the bra strap wherein the flexible bra cup and the bra strap are detachable from the multi-way sizing bra and each other.

* * * * *